US005791602A

United States Patent [19]

Capan

[11] Patent Number: 5,791,602

[45] Date of Patent: Aug. 11, 1998

[54] PLATE ANTENNA METHOD USING INTEGRAL NOISE MITIGATION FOR RAILWAY CAB SIGNAL

[75] Inventor: Ronald R. Capan, Pittsburgh, Pa.

[73] Assignee: Union Switch & Signal Inc., Pittsburgh, Pa.

[21] Appl. No.: 781,489

[22] Filed: Jan. 10, 1997

Related U.S. Application Data

[60] Division of Ser. No. 391,134, Feb. 21, 1995, Pat. No. 5,622,339, which is a continuation-in-part of Ser. No. 275,991, Jul. 15, 1994, Pat. No. 5,501,416, and Ser. No. 393,115, Feb. 21, 1995, Pat. No. 5,501,417.

[51] Int. Cl.[6] ..... B61L 1/00

[52] U.S. Cl. ..... 246/63 R; 246/194; 246/197

[58] Field of Search ..... 246/194, 63 R, 246/63 C, 193, 197, 63 A, 196

[56] References Cited

U.S. PATENT DOCUMENTS

| | | | |
|---|---|---|---|
| 1,328,865 | 1/1920 | Woodward . | |
| 1,794,584 | 3/1931 | Bushnell . | |
| 1,824,118 | 9/1931 | Bushnell . | |
| 1,824,145 | 9/1931 | Howe . | |
| 1,866,099 | 7/1932 | Godsey, Jr. . | |
| 2,000,166 | 5/1935 | Espenschied | 246/63 |
| 2,064,641 | 12/1936 | Bossart | 246/8 |
| 2,067,116 | 1/1937 | Brown | 246/63 |
| 2,105,134 | 1/1938 | Wintsch | 246/63 |
| 3,201,583 | 8/1965 | Rolle | 246/30 |
| 3,555,270 | 1/1971 | Persson | 246/194 |
| 3,840,737 | 10/1974 | Hoyler | 246/63 R |
| 4,274,611 | 6/1981 | Salmon | 246/34 R |
| 4,487,385 | 12/1984 | Salmon | 246/122 R |
| 4,720,067 | 1/1988 | Jaeger | 246/34 B |
| 5,263,670 | 11/1993 | Colbaugh et al. | 246/64 R |
| 5,501,417 | 3/1996 | Capan | 246/63 R |
| 5,586,736 | 12/1996 | Mollet | 246/63 R |
| 5,628,478 | 5/1997 | McConnel et al. | 246/63 R |

FOREIGN PATENT DOCUMENTS 248320 7/1926 United Kingdom .

*Primary Examiner*—Mark T. Le

*Attorney, Agent, or Firm*—Buchanan Ingersoll, P.C.

[57] ABSTRACT

Cab signalling apparatus for use on-board a vehicle which is propelled on tracks having a cab signal transmitted through rails. One or more plate mounted antenna is positioned above a rail to induce therein a signal representative of the cab signal current in the rail. A cab signal coil is mounted on at least one of the plates having an orientation generally perpendicular to the rail to receive a cab signal. A second noise coil is mounted on at least one of the plates to sense EMI representative of the undesired EMI induced in the cab signal coil. The preferred embodiments are that the plates have a generally rectangular profile and in some embodiments the plates will have a square profile. The respective noise and cab signal coils are angularly displaced from each other. In some embodiments a single core is used having both noise and cab signal coils mounted thereon, while other embodiments use multiple plates. On single plate embodiments the noise and cab signal coils may be overlapped or interleaved. The plates have mounting holes which permit angular adjustment in all directions.

11 Claims, 4 Drawing Sheets

PLATE ANTENNA METHOD USING INTEGRAL NOISE MITIGATION FOR RAILWAY CAB SIGNAL

RELATED CASES

This application is a divisional application of patent application Ser. No. 08/391,134, filed Feb. 21, 1995, now U.S. Pat. No. 5,622,339, which is a continuation-in-part of U.S. patent application Ser. No. 08/275,991, filed Jul. 15, 1994, now U.S. Pat. No. 5,501,416 and U.S. patent application Ser. No. 08/393,115, filed Feb. 21, 1995, now U.S. Pat. No. 5,501,417. The aforementioned U.S. application and patents are hereby incorporated by reference into this application.

BACKGROUND OF THE INVENTION

This invention relates to an antenna device for receiving cab signal information on-board a rail vehicle from a cab signal current which has been injected into the rails. The method of injecting a cab signal current into the rails and having the signal processed on-board the vehicle through use of antenna placed in front of the lead axle is well-know. Such antenna are sold by Union Switch & Signal Inc. of Pittsburgh, Pa., and one such antenna is designated Track Receiver N396278. Information that is necessary or desirable to be received on-board the vehicle, such as speed and track conditions, have been transmitted to the moving rail vehicle by use of track circuits for many years. Cab signal frequencies in the rail current are usually frequencies of approximately 60 and 100 hertz. The utilization of AC drive motors and variable frequency power can cause electromagnetic interference with existing cab signal antennas and control in some applications. While it is possible to filter or use other signal conditioning means to remove the sensed EMI from the cab signal antenna, it would be more desirable to mitigate the effects of the EMI at the antenna. U.S. Pat. Nos. 5,501,416 and 5,501,417 address apparatus and method which may be used to reduce the effects of EMI in receipt of cab signal. These methods and apparatus generally use a cab signal coil in a traditional means and in addition noise coils to sense EMI representative of the noise component which has been coupled into the cab signal coil. In many rail vehicles space beneath the undercarriage of the vehicle, especially in the area adjacent the wheels of the lead axle is very limited. In addition, because the vehicle is generally made of magnetically conductive materials, the electromagnetic radiation beneath a vehicle can vary widely. It is therefore desirable to have an AC cab signal antenna which can be conveniently mounted beneath the rail vehicle, and which mitigates the EMI sensed by the track signal sensing coil.

SUMMARY OF THE INVENTION

The invention provides for an apparatus and a method which permits railway track circuit cab signals to be received on-board a moving vehicle and provides mitigation of electromagnetic interference. The invention utilizes one or more plate members as the core for a cab signal antenna mounted on-board the vehicle. At least one of the plates in the antenna system has a cab signal coil wound around it in an orientation such that the coils sensing axis is generally perpendicular to the rail, so as to sense through inductive coupling the cab signal current in the rail. A second winding is provided in the antenna system which is angularly displaced from the cab signal coil. This noise coil is not as sensitive to the cab signal current as the cab signal coil.

However it is exposed to EMI which is identical to or highly representative of the EMI imposed upon the cab signal coil. In some embodiments a single plate is used containing both the cab signal coil and the noise coil. The preferred angular displacement between these coils is 90 degrees. Some embodiments use separate plates for the cab signal coil and the noise coil so that the angular displacement between the respective windings and between the planes of the plates can be adjusted or tuned to optimize the mitigation of EMI. While the respective cab signal and noise coils may be individually transmitted to the cab signal control equipment on-board the vehicle, it is generally preferred that the respective coils be connected in series with a polarity to cancel out the received EMI. In some applications it may be desirable to add passive or active circuit networks to assure that the phase relationship between the signals from the respective cab signal and noise coils is maintained.

DESCRIPTION OF CERTAIN EMBODIMENTS

Figure 1:
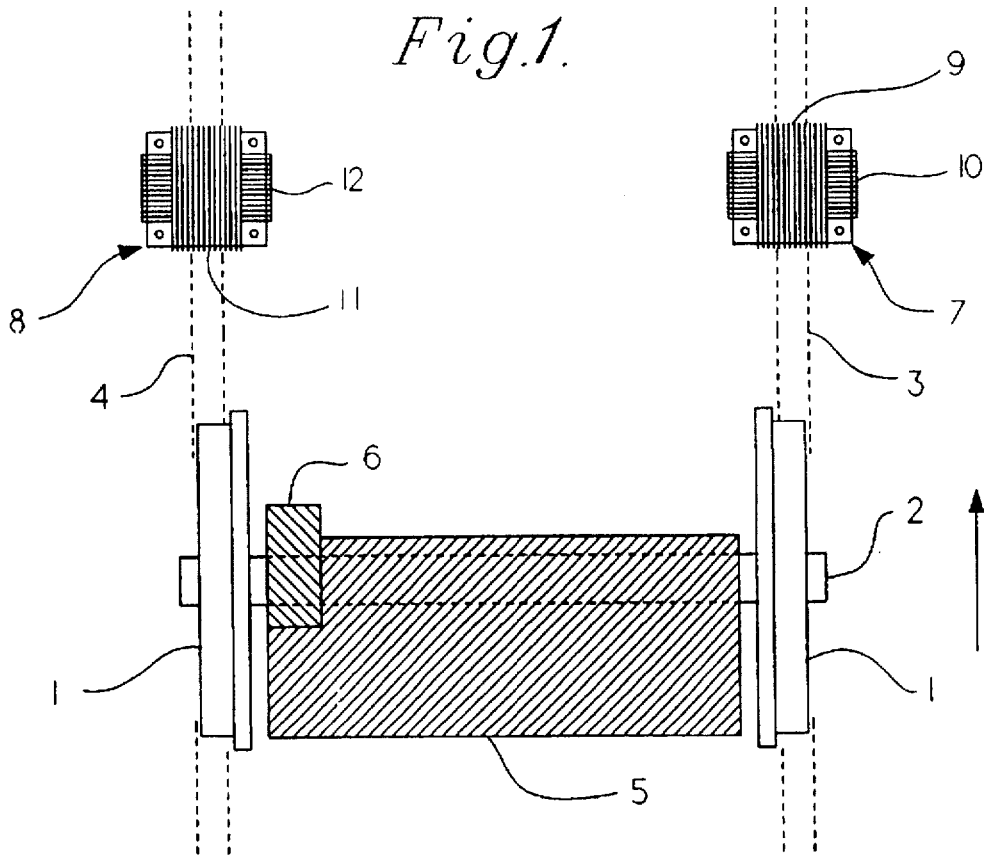
FIG. 1 is a diagrammatic representation of an embodiment showing the relationship between the plate antennas and the lead wheel axle assembly of a rail vehicle.

FIG. 1 shows the arrangement of two cab signal antennas positioned generally in front of a lead wheel axle assembly of a rail vehicle. Wheels 1 are attached to a lead axle 2 and driven by a propulsion motor 5 through a gear box 6. The direction of the rail vehicle is generally shown by the arrow as it moves along rails 3 and 4. In front of the lead axle and generally above rail 3 is positioned a right plate antenna 7. Similarly, above rail 4 and in front of the lead axle 2 is positioned a left plate antenna 8. The plate antennas 7 and 8 are generally positioned above their respective rails so as to detect a signal induced in the respective antennas from the cab signal current which is travelling in the rail. It is normally expected that the cab signal current will travel in one rail such as 3 through a wheel 1 through axle 2 and into the second wheel 1 and exit the wheel/axle assembly into rail 4. This current path is generally utilized in all cab signal arrangements. Since the cab signal current in rails 3 and 4 is generally the same, except for direction, the common practice has been to connect the respective right and left antenna signals together is series so as to add the respective sensed signals. As can be seen, the right plate antenna has a generally rectangular or square plate core having a right cab signal coil 9 wound around it. The cab signal coil 9 is wound in a direction having an axis generally perpendicular to the rail, so as to maximize the cab signal induced by the rail current. Similarly the left plate antenna 8 has a left cab signal coil 11 wound around it in a direction having an axis generally perpendicular to the rail 4. In addition, both the right and left plate antennas have wound around the cores respective right and left noise coils 10 and 12. The axis of the noise coils 10 and 12 is generally perpendicular to the axis of the respective cab signal coils 9 and 11. As can be seen, the noise coils 10 and 12 have their axis running generally parallel to the respective rails 4 and 3. Because the cab signal currents in rails 3 and 4 are generally travelling in the longitudinal direction of the rails, the signal induced in the noise coils 12 and 10 from the cab signal rail current is generally minimized. As the coils are oriented generally perpendicular to each other, the cab signal coils 9 and 11 sense a high component of the respective cab signal current. Because of the orientation of the noise coils axis as parallel to the cab signal current path, only a small component of the noise coil signal will be induced from the cab signal current in rails 3 and 4. Undesirable electromagnetic interference (EMI) can emanate from or be transmitted by a number of sources on-board a rail vehicle. However, it is believed that a large portion of the EMI is induced about the rail vehicle by the propulsion motor 5, especially if it is AC powered. Noisy DC propulsion motors can also produce undesired EMI. In addition to the propulsion motor itself, other sources may include the power cables feeding the propulsion motor and other conductive members or electrical devices on-board the vehicle. As can be seen in FIG. 1, because the respective core used for the cab signal coils and noise coils lay in the same plane, in fact they are the same core in this embodiment, they experience very similar EMI induced signals relative to the cab signal coils.

In the embodiment shown in FIG. 1 the respective right cab signal coil 9 and the left cab signal coil 11 can be connected into a series circuit such that their respective outputs are added. In addition, the electrical output from the respective right and left noise coils 10, 12 can be connected in a series arrangement with the respective cab signal coil 11 and 9, such that the EMI component signal of the noise coils cancels the EMI component signal of the respective cab signal coils. Such circuit arrangement is shown in FIG. 4.

Figure 4:
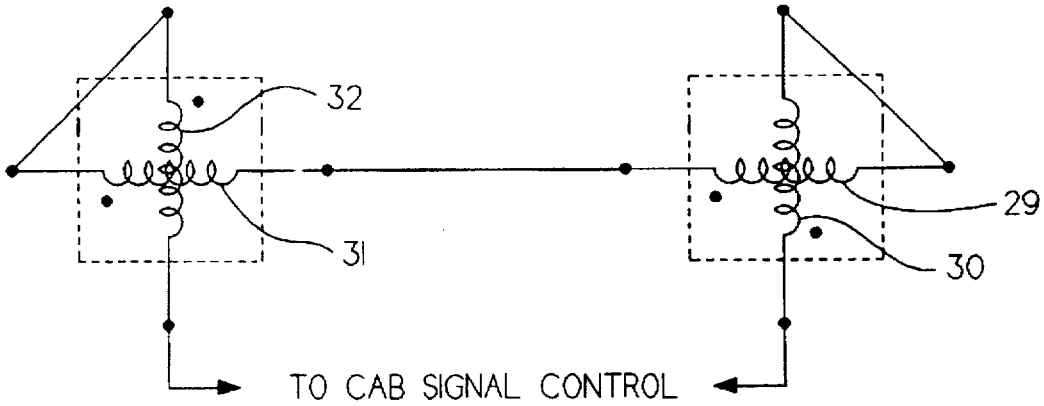
FIG. 4 is a circuit diagram showing the interconnection of the right and left antennas coils on a rail vehicle.

FIG. 4 shows a diagrammatic representation of one way to connect the respective cab signal and noise coils. Other ways can also be used in practicing this invention, including using passive or active circuitry with each coil to further enhance the signal qualities available to the cab signal controller. FIG. 4 shows a series arrangement in which the right cab signal coil 29, the right noise coil 30, the left cab signal coil 31, and the left noise coil 32 are connected in a series arrangement. This series connection uses the individual coils with polarities such that the total output to the cab signal control results in an enhanced cab signal value in which the individual components of EMI have been effectively reduced or cancelled. The series arrangement is the subject of U.S. Pat. Nos. 5,501,416 and 5,501,417.

Figure 2:
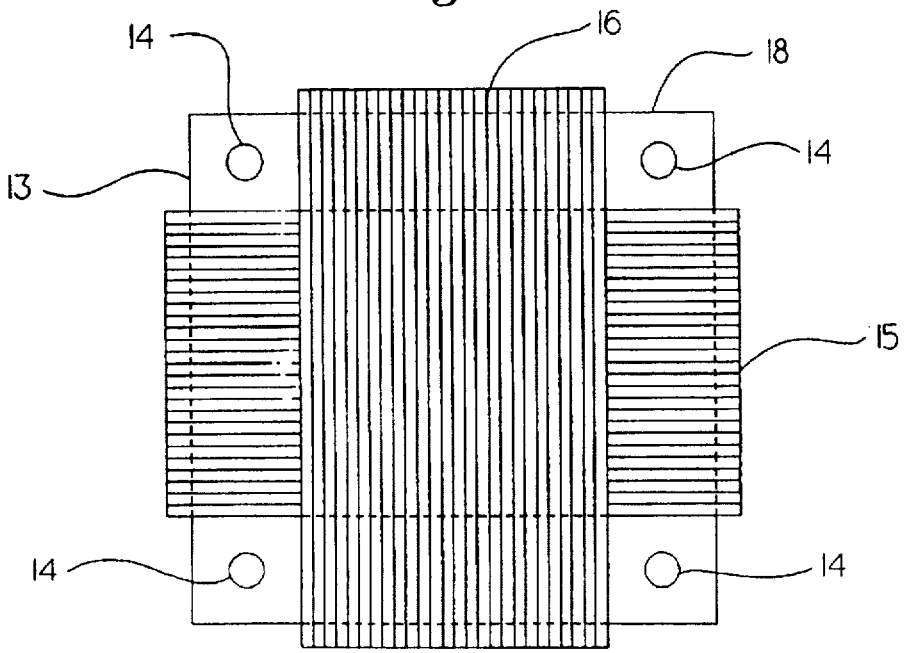
FIG. 2 is a plan view of a plate antenna.

FIG. 2 shows a plan view of a plate antenna of the general type shown in FIG. 1. A core 18 is shown which has a generally rectangular profile. In this embodiment the profile is square. Mounting holes 14 are shown in each corner of the core 18. Two coils are wrapped about the rectangular core 18, a noise coil 15 and a cab signal coil 16. As can be seen, these coils are generally at 90 degrees displacement with each other, and the respective axes of the core of these coils also are oriented 90 degrees with respect to each other. As shown in FIG. 2, the noise coil 15 and the cab signal coil 16 are wrapped around the core 18 and in fact on top of one another. The cab signal coil 16 is wrapped perpendicular to the noise coil 15 and over top of the noise coil 15. In other embodiments the effective noise and signal coils may be reversed with the cab signal coil adjacent the rectangular plate core, and the noise signal wrapped outward of the cab signal coil. In addition, it is also contemplated that in some applications it may be desirable to interlace or interweave the respective noise and cab signal coils so that an interleaved antenna results. As shown, the plate core 18 is generally rectangular and in fact in this embodiment is a square. In other embodiments, plates or rectangles other than squares may be utilized, in which the length to width aspect ratio can be used to tune the respective cab signal coil and the noise coil. Similarly, while the turns ratio as shown in FIG. 2 is generally equal, other turns ratios between the cab signal coil and the noise coil can be utilized. As shown in FIG. 2, the respective turns on both the noise coil and the cab signal coil extend over the center available portion of the plate core 18, leaving only the corners exposed in the areas of the mounting holes 14. In other embodiments, only portions of the core may be utilized for either the cab signal or the noise coil windings.

Figure 3:
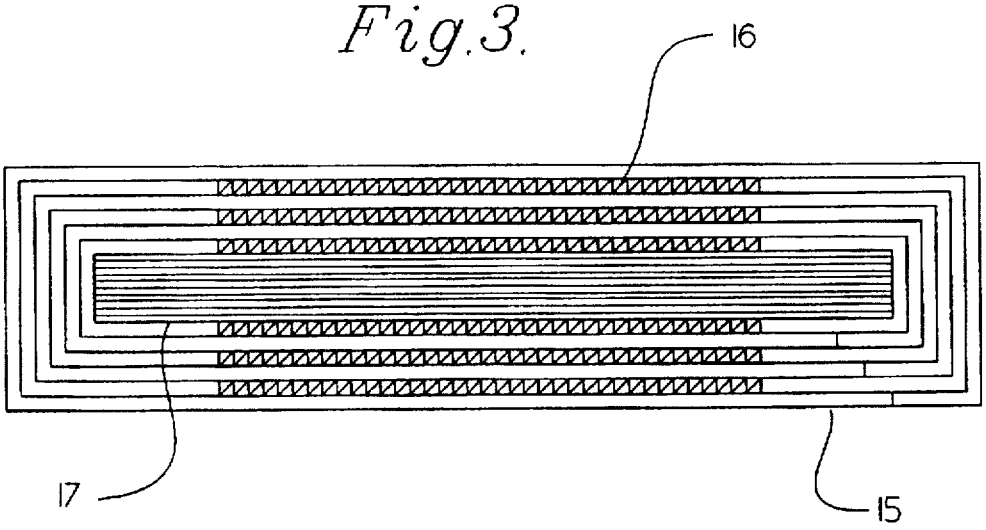
FIG. 3 is a cross-sectional view of an embodiment of an interleaved coil.

The plate antenna of FIG. 3 is shown in cross-section. The diagram of FIG. 3 shows that the plate core 17 may be composed of laminated magnetically conducting plates similar to those used in transformer and other magnetic devices. This is one preferred embodiment, although other core materials may be used in various other embodiments. Utilization of a rectangular profile and laminated plate stacked cores can generally reduce the cost of manufacture of the core and result in high core efficiency. Wound around plate core 17 is a cab signal coil 16. Also wrapped around plate core 17 is a noise coil 15. As can be seen in FIG. 3, the noise and cab signal coils 15 and 16 are both comprised of multiple turns and multiple winding layers. As shown in FIG. 3, the windings of the noise coil 15 are interlaced with the layers of windings of the cab signal coil 16. Such an arrangement results in a high integrity of construction such that the coils and their respective layers can be rigidly held to the core. In using a single plate core, it is desirable to have the same EMI induced signal in both the noise coil and the cab signal coil. A construction such as shown in FIG. 3 where a single coil is used and the respective windings are interleaved tends to insure that the EMI induced signals in the respective coils are very similar. As has previously been discussed, in some applications it may be desirable to add circuitry which can scale or shift the phase between the respective EMI components in the cab signal coil and the noise coil so that cancellation procedures can be implemented. Where applicable, it is advantageous to merely connect the coils in series as shown in FIG. 4 so as to improve the vitality of the overall cab signal system through utilization of only passive elements.

Figure 5:
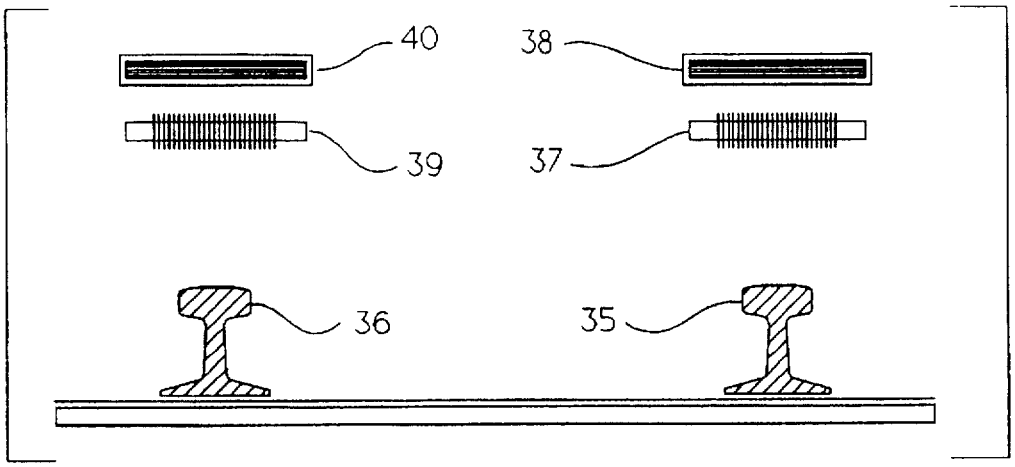
FIG. 5 is a cross-sectional diagram showing a multi-plate antenna array on each side of a rail vehicle in relation to the rails.

FIG. 5 shows an arrangement in which a multiple plate array antenna is used to mitigate EMI. The right antenna array is comprised of two plate mounted coils 37 and 38, while the left antenna array is comprised of two plate coils 39 and 40. Above the right rail 35 is located a right cab signal plate 37 having a respective cab signal coil wound around the outer surface of the plate core. The right cab signal coil 37 is mounted so that its axis is generally perpendicular to the axis of the rail 35. As seen in FIG. 5, the cab signal currents travelling in rail 35 will induce a signal in the right cab signal core and coil 37 which is mounted directly above rail 35. However, because the noise core and coil 38 assembly is oriented with the core in a generally parallel direction to the rail, little if any cab signal current will be induced in the noise core and coil 38. In addition because the cab signal core coil 37 is between the noise coil core 38 and the rail 35 some shielding from the cab signal induced current occurs to the core and noise coil 38. The left cab signal antenna shown in FIG. 5 also includes two core/coil assemblies, 39 a cab signal coil/core assembly, and 40 a noise core/coil assembly. The left coils 40 and 39 are likewise placed above the rail 36. As shown in FIG. 5, the respective cores are rectangular in cross-section, with a rectangular or square plan profile. Other profiles may be used, however in many applications it will be desirable to keep a relatively thin plate of rectangular profile.

Figure 6:
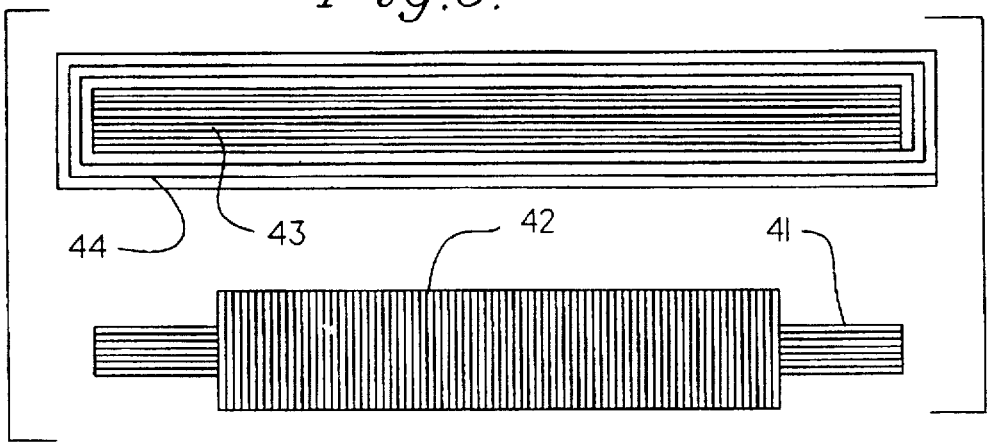
FIG. 6 is a view of an antenna having two plate arrays showing the relationship between the noise and cab signal coils and their respective cores.

Two element noise and antenna core/coil assemblies are shown in FIG. 6. These assemblies also have rectangular or square profiles and are of generally thin cross-section compared to the square profile dimensions. As shown the noise coil is mounted directly above the cab signal coil. A cab signal assembly is shown in the lower portion of FIG. 6 having a stacked laminated core 41 and a cab signal coil 42. Similarly, a laminated core 43 is shown in the upper noise assembly having an outer noise coil 44 wrapped there around.

Figure 7:
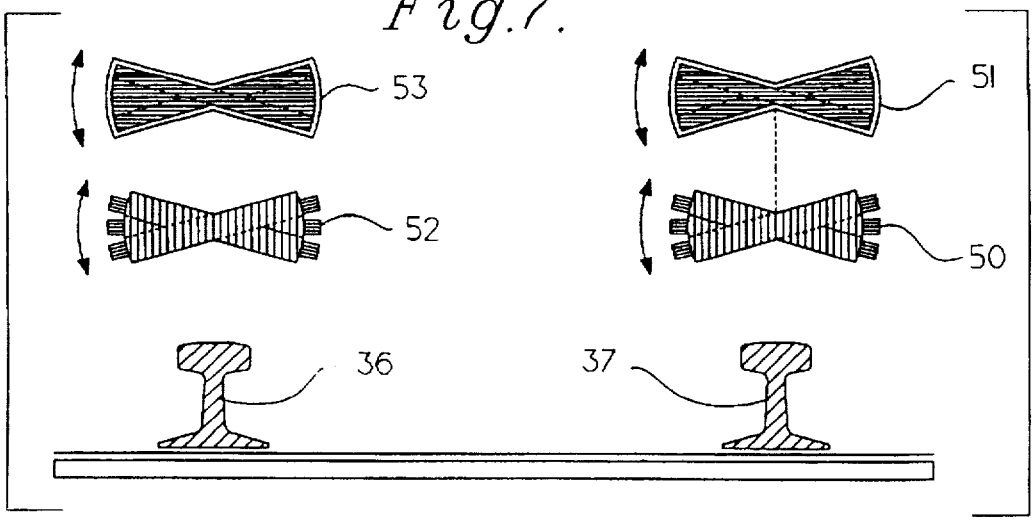
FIG. 7 is a diagrammatic view showing a mounting arrangement in a rail vehicle in which the antenna arrays are adjustable relative to the plane of the rails.

Because of the plate construction and the utilization of the mounting holes in the square profile, the positioning of multiple plate antennas and their orientation to both the rail vehicle and each other is easily obtained. FIG. 7 shows an arrangement in which a right signal plate assembly 50 and a right noise plate 51 may be mounted above a right rail 37. In addition, by utilization of the mounting holes 14 as shown in FIG. 2 the rectangular plate cores can be adjusted angularly relative to each other as shown in FIG. 7. Similarly, a left cab signal plate 52 and a left noise plate 53 can be adjusted independently above left rail 36. This flexibility allows for tuning the respective plate antennas relative to the specific vehicle on which they are to be mounted.

Figure 8:
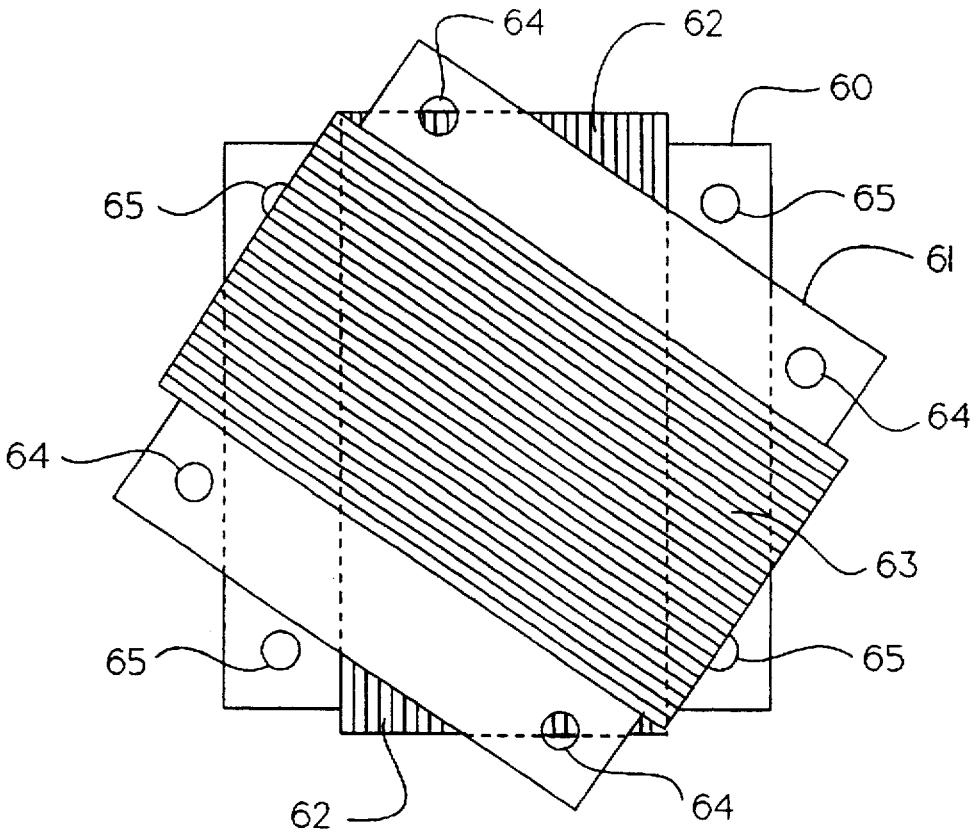
FIG. 8 shows a multiple plate antenna array viewed from the top in which the angle between the noise and signal coils are adjustable, each in their own plane.

FIG. 8 shows a plan view of a cab signal core 60 and a noise core 61. As shown, the respective cores could be mounted above a rail in which it is desired to sense the cab signal. Cab signal core 60 would be mounted closely adjacent the respective rail, with the noise core 61 mounted closely above the cab signal core 60. The angular displacement in all directions between the respective cab signal coil 62 and the noise coil 63 can be adjusted through utilization of the mounting holes 64 in the noise core and the mounting holes 65 in the cab signal core. In some arrangements where it is desired to tune for EMI on a rail vehicle the arrangements shown in FIGS. 7 and 8 may be used together to provide the exact tuning and phase relationship between the respective cab signal and noise coils and cores.

In describing this invention details have been given with regard to various embodiments. It is to be understood that those skilled in the art will be able to easily modify the techniques of the invention as taught herein to produce other embodiments which are particularly adapted to specific vehicle or environmental conditions. All such other embodiments are included within the scope the following claims.

I claim:

1. An antenna for inductively receiving a cab signal on-board a railway vehicle from a track circuit in a rail comprising:

a magnetically conducting noise core in a plate form;

a noise coil wound on said noise core;

a magnetically conducting cab signal core in the form of a plate;

a cab signal coil wound on said cab signal core;

said cab signal core positionable above such rail with said cab signal coil oriented generally perpendicular to such rail; and said noise core is positioned above said cab signal coil.

2. The antenna of claim 1 wherein said noise coil is oriented generally perpendicular to said lead axle.

3. The antenna of claim 1 wherein the plane of said noise coil is angularly adjustable relative to the plane of said cab signal coil.

4. The antenna of claim 3 wherein the plane of said cab signal coil is angularly adjustable relative to the plane of the rails on which said railway track vehicle moves.

5. The antenna of claim 1 wherein said noise core is of generally rectangular profile and said cab signal core is of generally rectangular profile.

6. The antenna of claim 5 wherein said noise core and said cab signal core are of generally the same profile.

7. The antenna of claim 6 wherein said same profile is generally square.

8. The antenna of claim 1 wherein said noise core lays in a plane generally parallel to the plane of said cab signal core.

9. A method of inductively receiving cab signals from a track circuit having a cab signal current in the rails thereon on-board a rail vehicle comprising:

profiling a plate noise core having a generally rectangular profile;

orienting a noise coil on said noise core in a direction generally parallel to said rail, said noise coil having an output;

profiling a plate cab signal core having a generally rectangular profile;

orienting a cab signal coil on said cab signal plate core oriented generally perpendicular to said rail said cab signal coil having an output and the output having an EMI component;

positioning said noise plate core above said cab signal core such that the output from said noise coil is representative of the EMI component in the output of said cab signal coil; and combining the respective outputs of said noise coil and said cab signal coil so as to reduce the EMI component from said cab signal coil.

10. The method of claim 9 further comprising angularly adjusting the relationship between said cab signal plate core and said noise plate core to reduce EMI.

11. The method of claim 10 further comprising profiling said plate noise core as a square; and profiling said plate cab signal core as a square.

* * * * *